US009855573B2

(12) United States Patent
Hursen

(10) Patent No.: US 9,855,573 B2
(45) Date of Patent: Jan. 2, 2018

(54) SUPERSONIC AIR KNIFE HANDLE

(71) Applicant: Thomas Francis Hursen, Allison Park, PA (US)

(72) Inventor: Thomas Francis Hursen, Allison Park, PA (US)

( * ) Notice: Subject to any disclaimer, the term of this patent is extended or adjusted under 35 U.S.C. 154(b) by 0 days.

(21) Appl. No.: 14/997,716

(22) Filed: Jan. 18, 2016

(65) Prior Publication Data

US 2016/0207057 A1 Jul. 21, 2016

Related U.S. Application Data

(60) Provisional application No. 62/104,521, filed on Jan. 16, 2015.

(51) Int. Cl.
*B25B 13/28* (2006.01)
*B05B 9/04* (2006.01)
*E02F 3/92* (2006.01)

(52) U.S. Cl.
CPC ..... *B05B 9/0403* (2013.01); *E02F 3/9206* (2013.01)

(58) Field of Classification Search
CPC ..... B25G 1/04; B25G 1/06; B05B 9/0403; E02F 3/9206
USPC ..... 81/111, 126, 118, 134
See application file for complete search history.

(56) References Cited

U.S. PATENT DOCUMENTS 1,895,156 A * 1/1933 Fisher ..... B01L 9/50 248/122.1
3,599,876 A 8/1971 Kyburg
3,647,142 A 3/1972 Drude
3,672,575 A 6/1972 Hinrichs
3,743,186 A 7/1973 Mocarski
3,766,810 A * 10/1973 Romak ..... B25B 27/0035 81/118
3,774,847 A 11/1973 Malec
3,790,084 A 2/1974 Kinsley
3,790,085 A 2/1974 Ayer
4,025,045 A 5/1977 Kubiak
4,026,474 A 5/1977 Knauer et al.
4,243,178 A 1/1981 Self
4,813,611 A 3/1989 Fontana
5,170,943 A 12/1992 Artzberger
5,212,891 A 5/1993 Schuermann et al.
5,285,965 A 2/1994 McCutcheon et al.
5,782,414 A 7/1998 Nathenson
(Continued)

FOREIGN PATENT DOCUMENTS

CN 202591169 * 12/2012 ..... B08B 5/02

*Primary Examiner* — Arthur O Hall
*Assistant Examiner* — Joel Zhou
(74) *Attorney, Agent, or Firm* — Blynn L. Shideler; Krisanne Shideler; BLK Law Group

(57) ABSTRACT

A supersonic air knife having a compressor and a barrel and nozzle includes an adjustable grasping handle assembly forming barrel handle comprising i) a pair of clasping elements, each clasping element having two gripping surfaces configured to engage the barrel at a point of engagement, with one point of engagement on each side of a first centerline of the barrel; ii) a pivot pin coupling the two clasping elements together on one side of the centerline of the barrel; and iii) A handle with a threaded element engaging the pair of clasping elements configured to draw the clasping elements together around the barrel.

7 Claims, 6 Drawing Sheets

(56) References Cited

U.S. PATENT DOCUMENTS

| | | | | |
|---|---|---|---|---|
| 7,185,834 | B1 * | 3/2007 | Davidson | B05B 9/007 239/104 |
| 8,171,659 | B2 | 5/2012 | Hursen | |
| 2006/0038033 | A1 * | 2/2006 | Daley | B05B 15/061 239/146 |
| 2008/0031678 | A1 * | 2/2008 | Gansebom | A46B 5/0095 401/139 |
| 2011/0101587 | A1 * | 5/2011 | Quintania | B25B 5/006 269/74 |
| 2014/0290445 | A1 * | 10/2014 | Tunningley | E21B 19/161 81/90.5 |

* cited by examiner

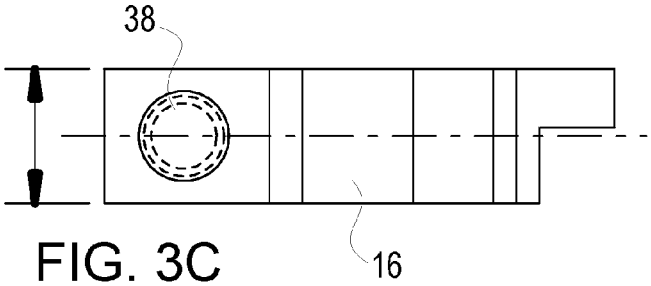
FIG. 3C
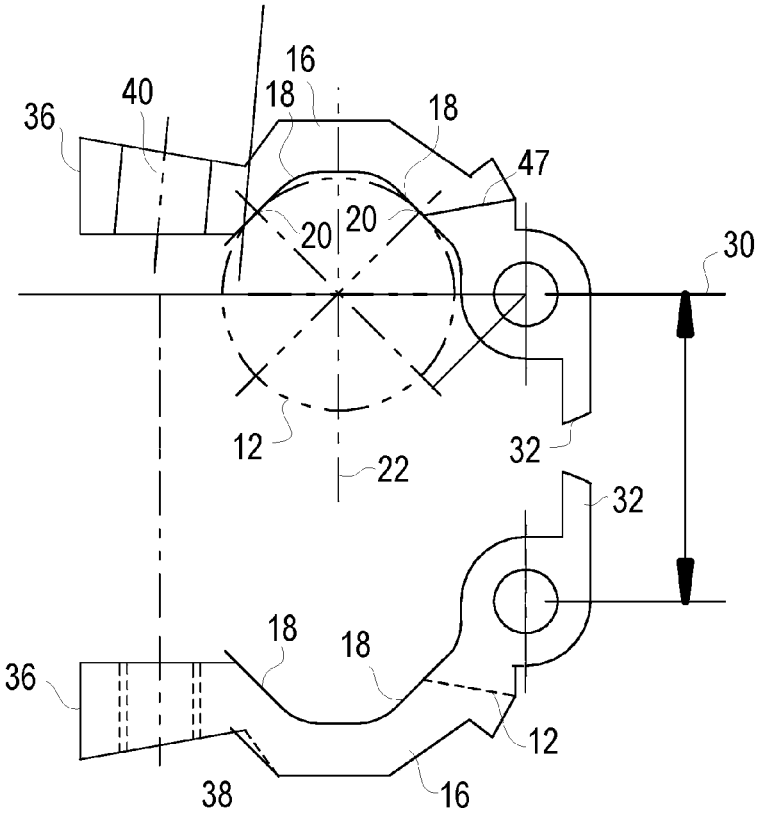
FIG. 3A
FIG. 3B
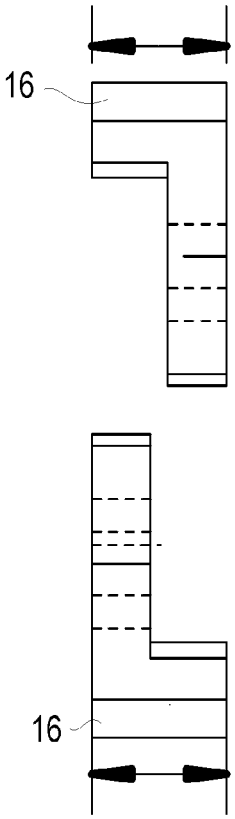

SUPERSONIC AIR KNIFE HANDLE

RELATED APPLICATIONS

This application claims priority to U.S. patent application Ser. No. 62/104,521 filed Jan. 16, 2015, entitled "Supersonic Air Knife Handle" which application is incorporated herein by reference in its entirety.

BACKGROUND INFORMATION

1. Field of the Invention

The present invention relates to supersonic air knife, more particularly a supersonic air knife handle and to a grasping handle assembly for a barrel, pipe or similar object.

2. Background Information

The present invention relates generally to air knives, and more specifically to the handles for supersonic air knives, and also to a grasping handle assembly for a barrel, pipe or similar object.

Air Knife Technology

In a conventional air knife associated with the present invention, compressed air, typically 90 to 100 psi, is converted to a supersonic jet while flowing through a nozzle especially designed for the purpose. The maximum jet velocity that can be achieved is determined by the pressure available from the compressor. Exit velocities in the range of Mach 1.6 to Mach 1.7 are typical for most portable compressors. Since the determining limit on Mach number for the exiting jet stream is the available pressure, higher Mach numbers can only be achieved by using higher compressor pressures. The air stream is initially the same diameter as the nozzle exit because the emerging jet stream diameter is the same as the nozzle exit diameter. For this reason, some refer to this characteristic as being laser-like. But as soon as the stream leaves the nozzle, it expands concentrically, since it is surrounded by atmospheric air.

High speed video of convention supersonic air knives shows the rapid expansion, but these videos also show that this high velocity air penetrates the ground to a depth of about a foot, creating a momentary cavity of about a foot in diameter, in which the dirt is crumbled. As the jet leaves that location or the air blast is ended, the dirt falls back on itself if the tool barrel is held close to the vertical. However, if the air knife barrel is inclined away from the user, the dirt can be blasted out the ground to a depth of one to two feet, depending upon technique. Since buried pipes, cables and tree roots are not porous the air knife use does not damage these elements, yet the dirt is removed from these structures. This aspect makes air knives quite popular for excavation of pipes and cables and for minimizing damage to ornamental trees.

For further details see regarding air knife technology and use see the inventors prior U.S. Pat. No. 8,171,659 entitled "Method and apparatus for selective soil fracturing, soil excavation or soil treatment using supersonic pneumatic nozzle with integral fluidized material injector;" and U.S. Pat. No. 8,171,659 entitled "Air Gun Safety Nozzle" which patents are incorporated herein by reference. U.S. Pat. Nos. 5,782,414, 5,212,891, 5,170,943, 4,813,611 all disclose related excavating pneumatic nozzle designs that are of interest and these are incorporated by reference as background. Representative examples of earlier air gun designs are shown in U.S. Pat. Nos. 3,599,876, 3,647,142, 3,672,575, 3,743,186, 3,774,847, 3,790,084, 3,790,085, 4,025,045, 4,026,474, 4,243,178, and 5,285,965 which are also incorporated herein by reference. From this prior art it can be seen that supersonic air knives are also referenced as compressed air guns, air blow guns, air jet guns, and a variety of similar terms. These will be referenced as supersonic air knives or air knives within this application.

The construction and operation of conventional air knives is known from the above cited prior art. There is a need for improved handles in the conventional supersonic air knives because of the elevated temperature of the compressed air passing through such a barrel. Some years ago in earlier air knife designs, this air was merely warm because portable air compressors had much larger stilling chambers in which the hot air from the compression process had time to mix and cool before entering the discharge air hose and then the supersonic air knife tool barrel. The original handle was wooden and glued to the barrel. The gluing was not reliable and the wood would dry and split in time as it was heated by the increasingly hot air generated by the compressed air flowing through the barrel interior.

This problem has continued over the years as compressor manufacturers gradually reduced the size of the stilling tank as a cost reduction measure until today they are so small the air heated by the compression process essentially receives no significant cooling affect from passing through current tanks as the further result of two routine requirements of today's typical supersonic air knife tool applications: large air mass flow and continuous or near continuous operation.

Thus plastic or rubber bicycle type handle grips replaced earlier wooden grips. These had the defect that an operator could easily allow their hand to slip up or down the barrel onto the hot portion of the barrel. Further these handle designs proved to be inadequate as a thermal insulator in practice due to the synergistic effect of the hot compressed air and the extreme environmental temperatures such as routinely occur in desserts or near dessert conditions.

More recently the air knife handles have been formed by commercially cast barrel claspers machining into two piece pipe hangers with threaded provision for a commercial handle or rod similarly threaded. The handle shifted the operator's grip away from the barrel to the handle for heat transfer isolation purposes. While this design was economical, it was prone to other problems. These barrel claspers have been of poor function, design and quality. They are also not convenient for the operator since the tightening screws require a separate tool (screw driver, Allen wrench, etc.) to reposition the handle assembly along the barrel. Pipe hangers usually require tightening in place on the pipe or barrel with a screw driver or wrench, and this construction is cumbersome when manual adjustments were desired to move the hanger along the barrel to a more useful position requiring loosening and then tightening the handle assembly in a new barrel position. Also, many hardware failures have been reported, in part because neither the pipe hanger hardware nor the plastic handle were intended for the more rigorous supersonic air knife applications as a construction tool. Such current hardware makes no provision for routine or random variation in barrel exterior shape or for unusual shapes. They provide no means of a controlled and predictable force multiplication which is necessary to avoid excessive hand torque sufficient to prevent slippage between handle assembly and barrel.

This invention is particularly useful for attachment to the barrel of supersonic air knives and addresses the problems of the prior art. The handle of the present invention may also serve as a grasping handle assembly for a barrel, pipe or similar object.

SUMMARY OF THE INVENTION

This invention is directed to a cost effective, efficient, and easy to implement handle for supersonic air knives, and also to a grasping handle assembly for a barrel, pipe or similar objects.

One embodiment of the present invention provides a supersonic air knife having a compressor and a barrel and nozzle includes an adjustable grasping handle assembly forming barrel handle comprising i) a pair of clasping elements, each clasping element having two gripping surfaces configured to engage the barrel at a point of engagement, with one point of engagement on each side of a first centerline of the barrel; ii) a pivot pin coupling the two clasping elements together on one side of the centerline of the barrel; and iii) A handle with a threaded element engaging the pair of clasping elements configured to draw the clasping elements together around the barrel.

The supersonic air knife according to one embodiment of the present invention provides that each gripping surface is a generally flat gripping surface. A generally flat gripping surface within the meaning of this application defines a gripping surface that has a point or line contact with the barrel.

The supersonic air knife according to one embodiment of the present invention provides that a center of the pivot pin lies on a second centerline of the barrel which is generally perpendicular to the first centerline. Generally perpendicular within the meaning of this application means within 5 degrees.

The supersonic air knife according to one embodiment of the present invention further includes a limiting stop extending from at least one clasping element, or both clasping elements, and extending to an opposite side of the second centerline from the gripping surfaces of the limiting stop clasping element, and wherein each limiting stop is configured to define the maximum open position of the pair of clasping elements.

The supersonic air knife according to one embodiment of the present invention wherein the angle between the first centerline and each point of engagement is equal for each gripping surface for each clasping element.

The supersonic air knife according to one embodiment of the present invention provides that each clasping element includes a handle engaging lug extending to a distal end opposite the side of the clasping element engaging the pivot pin. Further at least one lug is threaded and configured to receive the threaded element of the handle.

The supersonic air knife according to one embodiment of the present invention provides that the handle includes an enlarged gripping portion extending generally parallel to the first centerline. Generally parallel within the meaning of this specification is within 5 degrees.

The supersonic air knife according to one embodiment of the present invention provides that the clasping elements are formed of metal and wherein the clasping elements are substantially identical and wherein the angle between the first centerline and each point of engagement is in the range of approximately 45 degrees to 66.4 degrees.

The present invention is not limited to super sonic air knifes and handle assemblies therefore, as one aspect of the invention provides an adjustable grasping handle assembly for a barrel, pipe or other similar object comprising: i) a pair of clasping elements, each clasping element having two gripping surfaces configured to engage the barrel at a point of engagement, with one point of engagement on each side of a first centerline of the barrel; ii) a pivot pin coupling the two clasping elements together on one side of the centerline of the barrel; and iii) A handle with a threaded element engaging the pair of clasping elements configured to draw the clasping elements together around the barrel.

The handle assembly of the present invention may be described as a barrel handle or pipe hanger comprising a clasping set of elements, each element formed substantially in a single continuous manufacturing process, each element exterior shape the same as the other element exterior shape. The contact surfaces of the clasping elements upon the pipe or barrel being essentially flat, located and angled so as to define a contact line between the claspers and the pipe. The contact location(s), direction and magnitude of the resulting clasping force multiplication being determined by the combinations specifics and not limited by practical manufacturing variations in the pipe exterior shape or diameter. A portion of an element shape may be provided to limit opening of the two elements to protect the device from accepting barrels that could overload the device.

These and other aspects of the present invention will be clarified in the description of the preferred embodiment of the present invention described below in connection with the attached figures in which like reference numerals represent like elements throughout.

BRIEF DESCRIPTION OF THE DRAWINGS

FIG. 3A is a schematic top plan view, partially exploded, of the clasping elements of the handle assembly of FIG. 1A;

FIG. 3B is a side elevation view of the clasping elements of the handle assembly of FIG. 3A;

FIG. 3C is an end elevation view of one clasping element of the handle assembly of FIG. 3A;

BRIEF DESCRIPTION OF THE PREFERRED EMBODIMENTS

Figure 1A:
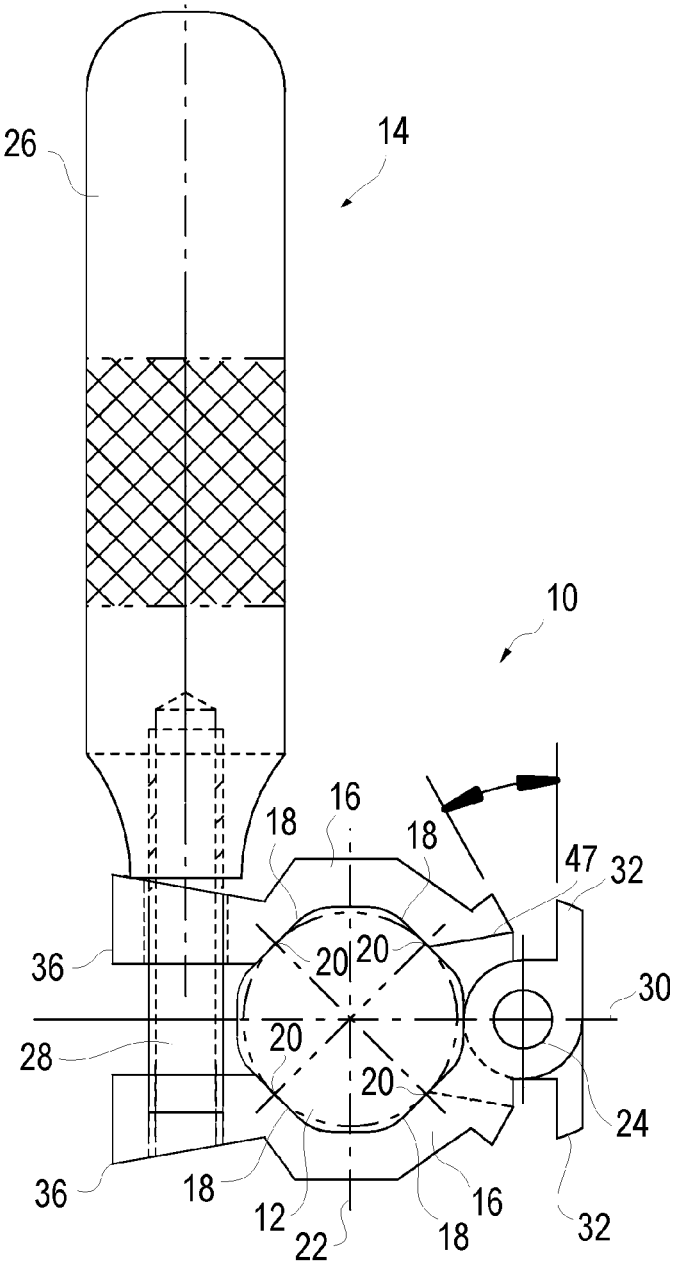
FIG. 1A is a schematic top plan view of a supersonic air knife with adjustable handle assembly according to one embodiment of the present invention.

This invention is directed to a cost effective, efficient, a supersonic air knife 10 having a compressor; a barrel 12 and nozzle coupled to the compressor; and an adjustable grasping handle assembly 14 coupled to the barrel 12 comprising i) a pair of clasping elements 16, each clasping element 16 having two gripping surfaces 18 configured to engage the barrel 12 at a point of engagement 20, with one point of engagement 20 on each side of a first centerline 22 of the barrel 12; ii) a pivot pin 24 coupling the two clasping elements 16 together on one side of the first centerline 22 of the barrel 12; and a handle 26 with a threaded element 28 engaging the pair of clasping elements 16 configured to draw the clasping elements 16 together around the barrel 12.

As described in greater detail below, each gripping surface 18 is a generally flat gripping surface 18. As shown in the figures a center of the pivot pin 24 lies on a second centerline 30 of the barrel 12 which is generally perpendicular to the first centerline 22.

Figure 6:
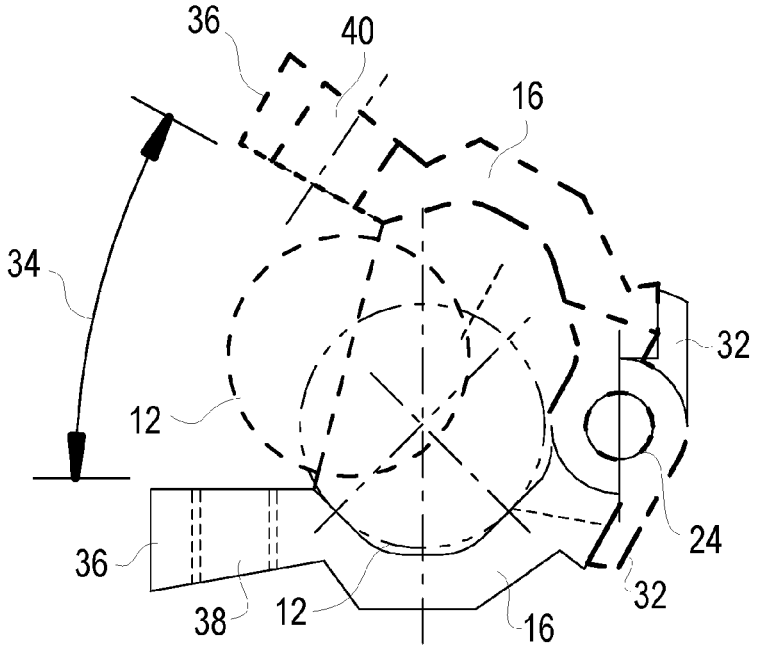
FIG. 6 is a schematic top plan view of the supersonic air knife and handle assembly of FIG. 5A and which Illustrates the open position of the handle assembly which protects the handle assembly from being overloaded by an oversized barrel.

The supersonic air knife 10 according to the embodiments shown in FIGS. 1-4 further including a limiting stop 32 extending from each clasping element 16 and extending to an opposite side of the second centerline 30 from the gripping surfaces 18 of the limiting stop clasping element 16, and wherein the limiting stop 32 is configured to define the maximum open position (angle 34) of the pair of clasping elements 16 as shown in FIG. 6.

The supersonic air knife 10 according to the invention wherein the angle (a or b) between the first centerline 22 and each point of engagement 20 is equal for each gripping surface 18 for each clasping element 16. As described below, each clasping element 16 includes a handle engaging lug 36 extending to a distal end opposite the side of the clasping element 16 which is engaging the pivot pin 24. Further as described below, one lug 36 includes a threaded through hole 38 which is configured to receive the threaded element 28 of the handle 14. As shown, the handle 14 included an enlarged gripping portion with gripping elements 42 wherein the enlarged gripping portion extends generally parallel to the first centerline. The lug 36 adjacent the enlarged gripping portion with gripping elements 42 includes a through hole 40 that does not need to be threaded.

As noted below the clasping elements 16 may be formed of metal, and the clasping elements 16 may be substantially identical in shape and wherein the angle (a or b) between the first centerline 22 and each point of engagement 20 is in the range of approximately 45 degrees to 66.4 degrees.

The handle assembly 14 may be a barrel handle or pipe hanger and may be described as comprising a clasping set of elements 16, each element 16 formed substantially in a single continuous manufacturing process, with each element 16 exterior shape the same as the other element 16 exterior shape. The contact or gripping surfaces 18 of the clasping elements 16 upon the pipe or barrel 12 are essentially flat as noted above, and are located and angled so as to define a contact point 20 or line between the clasping elements 16 and the barrel 12. The contact points 20 (or location(s)), and the direction and magnitude of the resulting clasping force multiplication on the barrel 12 are not limited by the manufacturing variations in the barrel 12 exterior shape or barrel 12 diameter.

A portion of a clasping element 16, namely the limiting stop 32, may be provided to limit opening of the two clasping elements 16, as shown in FIG. 6, to protect the handle assembly 14 from accepting barrels 12 that could overload the assembly 14.

FIG. 1A illustrates the preferred form of the handle assembly 14 in a closed and tight position on a generally round barrel 12 exterior of a supersonic air knife 10. The barrel 12 could be another barrel or pipe assembly other than an air knife component.

The threaded element 28 of the handle assembly 14 can act as shown upon the two clasping elements 16 which are held in place at the opposite end by the pivot pin 24. The clasping elements 16 surround the generally round, elliptical or hexagonal barrel 12, or pipe. The pivot pin 24 permits rotation of the clasping elements 16 into an open position sufficient to accept entry of the barrel 12 into the clasping elements 16, and then permits rotation of the clasping elements 16 back into position to grip the barrel 12.

An optional feature of the exterior shape of the clasping elements 16 is the limiting stop 32 which operate to limit the degree of opening of the clasping elements 16 when accepting a barrel 12 so as to protect the handle assembly 12 from mechanical overload. As noted above a portion of the handle has a roughened outer surface 42 to increase the effectiveness of the hand grip.

Figure 2C:
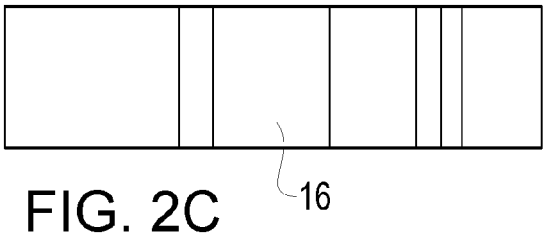
FIG. 2C is an end elevation view of the clasping element of FIG. 2A.
Figure 2A:
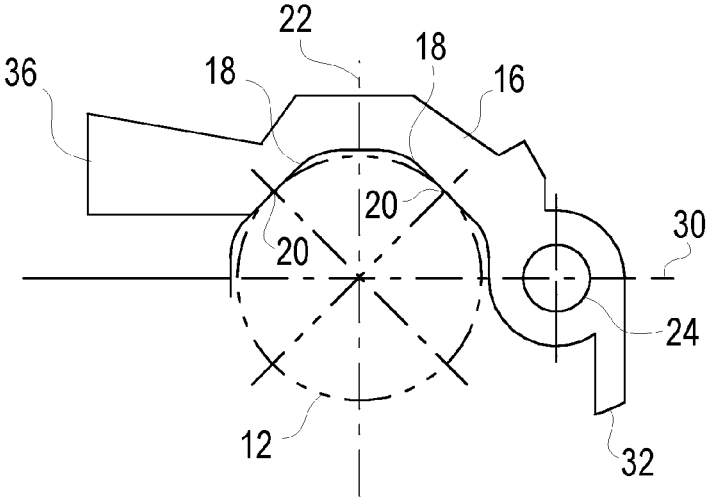
FIG. 2A is a schematic top plan view of one clasping element of the adjustable handle assembly of FIG. 1A prior to a handle receiving hole being formed therein.
Figure 2B:
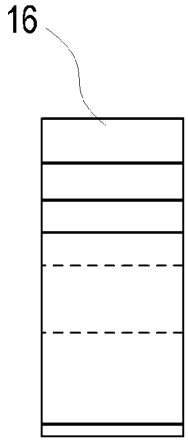
FIG. 2B is a side elevation view of the clasping element of FIG. 2A.
Figure 4C:
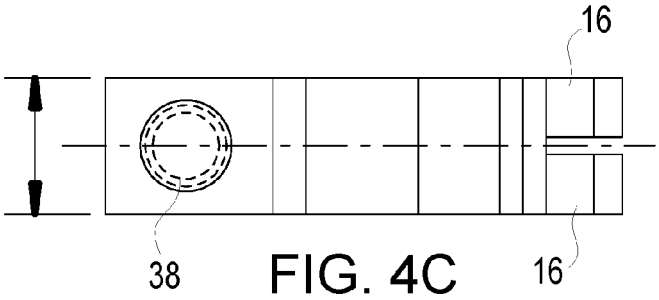
FIG. 4C is an end elevation view of the clasping elements of the handle assembly of FIG. 4A.
Figure 4A:
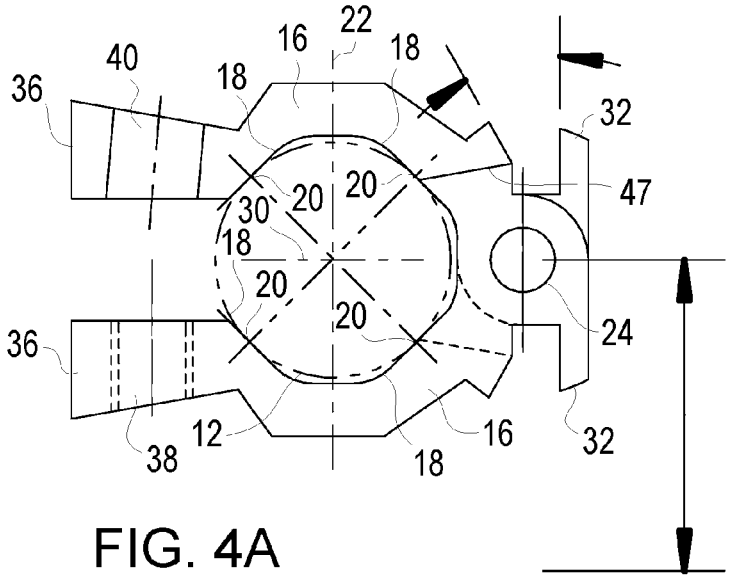
FIG. 4A is a schematic top plan view of the clasping elements of the handle assembly of FIG. 1A.
Figure 4B:
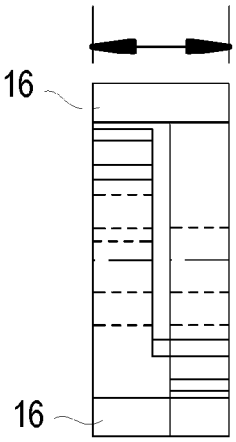
FIG. 4B is a side elevation view of the clasping elements of the handle assembly of FIG. 4A.

FIGS. 2, 3 and 4 may be viewed as sequential manufacturing stages. In FIG. 2 each of the two clasping elements 16 begin as the same shaped element formed from metal which may be cut to shape by water jetting or other continuous cutting means. Referring to FIG. 3, two of the single clasping elements 16 are provided and one element 16 is reversed to become the second clasping element 16. Each clasping element 16 has a finish machining operation applied to produce the finished details, namely a drilled hole 40 of the clasping element 16 adjacent the enlarged handle portion and a threaded hole 38 in the opposite clasping element 16.

Figure 5B:
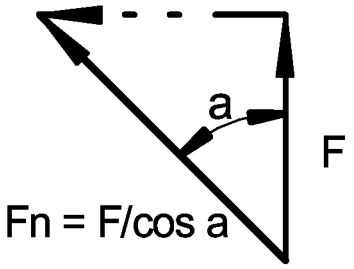
FIGS. 5B-C are force diagrams for the modified clasping element of FIG. 5A.
Figure 5C:
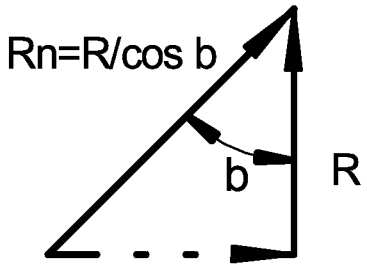
Figure 5A:
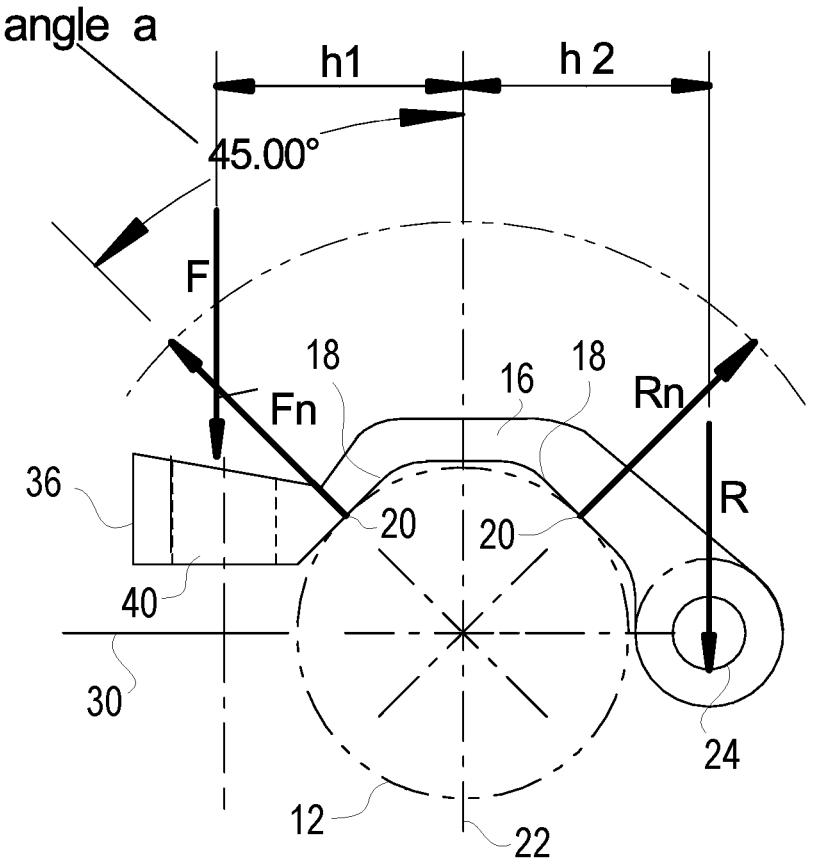
FIG. 5A is a schematic force diagram for a modified clasping element of the handle assembly of FIG. 1A.

FIG. 4 shows the two clasping elements 16 in an assembled position, joined by a suitable pivot pin 24 through openings, before receiving the threaded member 28 of the handle assembly 14 that applies the motive barrel holding force. FIG. 5A illustrates one of the clasping elements 16 and the primary forces acting on this one clasping element 16 as a free body.

FIG. 5A also illustrates the structure at the approximate minimum angle "a" or "b" of the flat gripping surfaces 18. FIG. 5B and FIG. 5C illustrate respectively the magnitude of the reacting force Fn as a function of the applied force F and the magnitude of the reacting force Rn as a function of the force R which is reactive to force F. FIG. 5A also illustrates an alternative form of the clasping elements 16 without the limiting stops 32.

Figure 7:
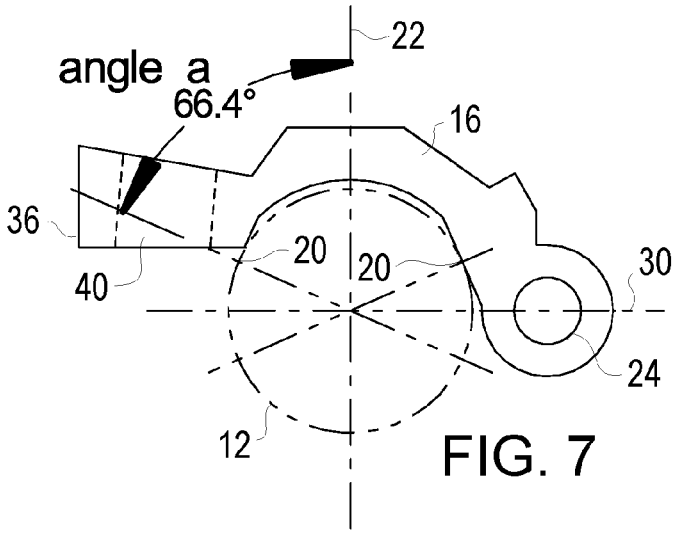
FIG. 7 is a schematic top plan view of the supersonic air knife and handle assembly at the approximate maximum angle of engagement for the handle assembly.

FIG. 6 Illustrate the maximum open position of the clasping elements 16 relative to each other that protects the handle assembly 14 from being overloaded by an oversized barrel 14. FIG. 7 Illustrate the handle assembly 14 at the approximate maximum angle of angle "a" of the flat gripping surfaces 18.

Figure 1B:
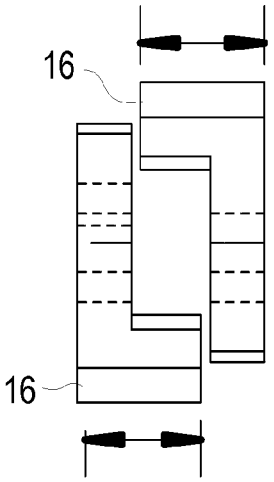
FIG. 1B is a schematic side elevation view of the pair of clasping elements of the adjustable handle assembly of FIG. 1A.

The present invention may be summarized as providing the supersonic air knife 10 with adjustable handle assembly 14 as shown in FIG. 1 which illustrates the preferred embodiment in a closed and tight position on a generally round barrel 12 exterior. The actuating threaded element 28 of a handle assembly 14 can act upon the two clasping elements 16 held in place at the opposite end by the pivot pin 24, and surrounding the generally round barrel 12. The pivot pin 24 permits rotation of the clasping elements 16 into an open position sufficient to accept entry of the barrel 12 into the clasping elements when the enlarged handle portion and threaded element 28 are removed.

The limiting stops 32 of each clasping element 16 are intrinsic external shape features that work in conjunction with each other to limit the size of the barrel 12 received within the handle assembly 14 which is particularly useful when this handle assembly 14 is used as a pipe hanger and to a lesser degree when used as a barrel handle. This limiting operation is best illustrated in FIG. 6.

The gripping elements 42 of the enlarged gripping portion, which may be formed as a knurled or roughened surface, can enhance the applied hand torque that may be generated. However, the primary force multiplication between the hand applied force from the enlarged gripping portion and threaded element 28 and the reactive force between the clasping elements 16 and the barrel 12 is a result of the relative locations of the pivot pin 24, the clasping element 16 configuration, the contact point 20 locations against the barrel 14 plus the angularity of the force through the contact point 20 relative to the direction of the force applied at the threaded element 28 and reflected at the pivot 24.

As an example, the clasping element 16 has the flat surfaces 18 where they contact the barrel 12 exterior at contacts 20 which can only develop a gripping force perpendicular to the surface 18 (independent of friction), and which requires the perpendicular force (Fn) between the local clasping element 16 at each barrel contact point 20 (or edge) to be a specific multiple of the applied handle force (F). As a result the applied force(s) at each clasping element surface 18 is multiplied predictably.

Another advantage of this configuration is regardless of the exact exterior shape of the barrel 14 (but generally rounded or elliptical), each of the four clasper surfaces 18 will only contact the barrel 14 exterior at one point as viewed from the end of the barrel 12 or along a single line as viewed from the side of the barrel 14. This makes the following calculations feasible and predictable and produces a higher force perpendicular to the clasping element surface 18 and a resulting higher friction between barrel 12 and clasping elements 16 to resist sliding or rotating loss of position than is otherwise presently available.

The manufacturing process is unique, simple and economical as illustrated sequentially in FIGS. 2, 3 and 4. In FIG. 2 each of the two clasping elements 16 begin as a single item cut to shape by water jetting or other continuous cutting means from a metal plate of uniform material thickness. FIG. 3 shows two of the single items forming the clasping elements 16, one element being reversed to become the second clasping element 16 of the pair. A specific finishing machining operation is applied to produce finished details of each clasping element 16 as shown. This machining example includes a drilled hole non-threaded hole 40 and a clearance cut 47 on one clasping element 16 and a threaded hole 38 and a clearance cut 47 on the other clasping element 16. It should be obvious that two non-threaded holes 40 may be used is the threaded element 28 co-operates with a nut, but the uses of threaded hole 38 allows for one handed tightening.

FIG. 4 shows the two clasping elements 16 in assembled position joined by a suitable pivot pin 24, before receiving the threaded member 28 of the handle assembly 14 that applies the motive force.

FIG. 5A illustrates the geometric structure responsible for the primary force multiplication acting on the free body of the clasping element 16. FIG. 5B and FIG. 5C illustrate the resolution of the developed normal forces Fn and Rn into their respective vector components. It also illustrates the handle assembly 14 at the approximate minimum angle "a" and "b" of the flat gripping surfaces 18. The axial applied force of the threaded member 28 is (F). The nearby flat gripping surface 18 can only generate a normal reaction force (Fn) perpendicular to it's surface at it's contact point 20 against the barrel 12. Vector diagram of FIG. 5B resolves this relationship. This requires (Fn) to be equal to F/(cos a). This is one of several elements of magnification of the applied force (F).

The following calculations illustrate those that are used to determine and illustrate the improved mechanical advantage of this handle assembly 14. The following details the necessary calculations further including the repeat of the vector relations of FIGS. 5B and 5C in proper sequence. For convenience the generated forces Fn and Rn are located to pass through the center of barrel 12. Lengths h1 & h2 are set equal to each other for convenience.

Moments about the center may be used to calculate force (R) induced at pivot pin 24 as equal to the applied force (F).

i) Moments About Center:

$$(F)(h1)=(R)(h2)$$

$$h1=h2$$

$$(F)=(R)(h2)/(h1)$$

$$(F)=(R)$$

As shown FIG. 5B shows the relationship between force F and Fn, while FIG. 5C shows the relationship between force R and Rn. The friction inducing force (FIF) may be related to Fn and the angle "a".

ii) Friction Inducing Force (FiF) (Total Acting on Pipe)

$$(\mathrm{FiF})=4(Fn)$$

$$(Fn)=(F)/(\cos a)$$

$$(\mathrm{FiF})=4(F)/(\cos a)$$

A table of calculated values of the Friction Inducing Force (FIF) as a function of a range of values of angle "a" follows:

iii) Determine (Fn) & (FiF) where a=b

| A | Cos a | Fn | (FiF) |
|---|---|---|---|
| 22.5 | 0.924 | 1.08 F | 4.33 (F) |
| 45.0 | 0.707 | 1.41 F | 5.66 (F) |
| 60.0 | 0.500 | 2.00 F | 8.00 (F) |
| 66.4 | 0.4003 | 2.50 F | 9.99 (F) |
| 89.0 | 0.0175 | 57.15 F | 228.57 (F) |

The approximate practical range of angle "a" (and "b") is 45 degrees to 66.4 degrees and it has a resulting range of multiplication effect on (FIF) of between 5.66 (F) and 9.99 (F).

A reference value of normal force Fn may be calculated and the calculated friction inducing force (fif) for a standard commercial clasper that locates the motive force F, the pin 24 and the barrel 14 center each in the same physical relationship to each other as the same elements of this invention. But this prior art device does not have the multiple flat and multiple angular grasping surfaces and other features disposed as this invention.

iv) Simple Lever Reactions at Pipe $$(Fn)=(Rn)=2(F) \text{ and } (\mathrm{fif})=(Fn)+(Rn)=4(F)$$

A review of the relative increase of (FIF) of this invention relative to (fif) of the standard device is as follows:

iv) Range of Advantage $$(\mathrm{FiF})/(\mathrm{fif})=1.41$$

$$(\mathrm{FiF})/(\mathrm{fif})=2.5.$$

This range for angle "a" between 45 degrees and 66.4 degrees being a multiplication range of 1.41 to 2.50.

FIG. 6 illustrates the protective limitation against oversize barrel loading of the handle assembly. One clasping element 16 is shown rotated about 24 to the position in which the limiting stops 32 prevent further opening such that the maximum open angle limit 34 occurs which permits the open diameter limit to be sufficient to allow the barrel 14 below the maximum diameter to enter within the open clasping elements 16. As shown the barrel entry limit is somewhat larger than the displaced barrel.

FIG. 7 Illustrates the structure of the clasping elements at the approximate maximum 66.4 degree angle for angle "a" of the flat gripping surface 18.

In summary the invention provides a grasping handle assembly 14 for a barrel 14, pipe or other similar object, specifically a supersonic air knife 10, consisting of two clasping elements 16 drawn together around the barrel 12 by action of a threaded handle member in cooperation with a pivot pin 24 where the gripping effectiveness is increased and/or enhanced by the application of opposed generally flat and/or angular shaped gripping surfaces 18 in association with the threaded member 28, the pivot pin 24 and each other. As shown the angle "a" is in the range of approximately 45 degrees to 66.4 degrees in relation to the plane of the force developed by the threaded member 28 so as to produce a further force multiplication of the gripping force.

The invention describes a method of manufacture of two or more such elements 16, intended to operate in conjunction with each other whereby each of the two elements are substantially of the same external shape and that external shape capable of being substantially formed by a single continuous material forming operation such as water jetting, laser cutting, milling or casting. Further the invention includes the capability of at least one of the clasping elements capable of being reversed so as to cooperatively function. Further the invention provides that a common external or internal feature, fixed or adjustable, of each clasper is provided that limits the opening of the assembled claspers so as to avoid entry of larger pipes, barrels or other objects that might exceed the load capacity of the claspers.

It is apparent that many variations to the present invention may be made without departing from the spirit and scope of the invention. The present invention is defined by the appended claims and equivalents thereto.

What is claimed is:

1. A supersonic air knife comprising:

A compressor;

A barrel and nozzle coupled to the compressor; and

An adjustable grasping handle assembly coupled to the barrel comprising:

i) a pair of clasping elements, each clasping element having two gripping surfaces configured to engage the barrel at a point of engagement, with one point of engagement on each side of a first centerline of the barrel, wherein each gripping surface is a generally flat gripping surface;

ii) a pivot pin coupling the two clasping elements together on one side of the centerline of the barrel, wherein a center of the pivot pin lies on a second centerline of the barrel which is generally perpendicular to the first centerline; and iii) A handle with a threaded element engaging the pair of clasping elements configured to draw the clasping elements together around the barrel; and iv) a limiting stop extending from at least one clasping element and extending to an opposite side of the second centerline from the gripping surfaces of the limiting stop clasping element, and wherein the limiting stop is configured to define the maximum open position of the pair of clasping elements.

2. The supersonic air knife according to claim 1 wherein the angle between the first centerline and each point of engagement is equal for each gripping surface for each clasping element.

3. The supersonic air knife according to claim 2 wherein each clasping element includes a handle engaging lug extending to a distal end opposite the side of the clasping element engaging the pivot pin.

4. The supersonic air knife according to claim 3 wherein at least one lug is threaded and configured to receive the threaded element of the handle.

5. The supersonic air knife according to claim 4 wherein the handle included an enlarged gripping portion extending generally parallel to the first centerline.

6. The supersonic air knife according to claim 5 wherein the clasping elements are formed of metal.

7. The supersonic air knife according to claim 6 wherein the clasping elements are substantially identical and wherein the angle between the first centerline and each point of engagement is in the range of approximately 45 degrees to 66.4 degrees.

* * * * *